United States Patent [19]

Talley

[11] 4,446,615

[45] May 8, 1984

[54] APPARATUS FOR ATTACHING TERMINALS TO THE ENDS OF ELECTRIC CONDUCTORS

[75] Inventor: Lloyd A. Talley, Valinda, Calif.

[73] Assignee: Eubanks Engineering Company, Monrovia, Calif.

[21] Appl. No.: 358,833

[22] Filed: Mar. 16, 1982

[51] Int. Cl.[3] ..... H01R 43/04

[52] U.S. Cl. ..... 29/742; 29/753; 29/759

[58] Field of Search ..... 29/742, 753, 759, 564.3, 29/564.4, 564.1, 564.6

[56] References Cited

U.S. PATENT DOCUMENTS

| | | | |
|---|---|---|---|
| 3,204,334 | 9/1965 | Long et al. | 29/753 |
| 3,456,324 | 7/1969 | Hahn et al. | 29/759 X |
| 4,244,101 | 1/1981 | Talley | 29/753 X |

*Primary Examiner*—Carl E. Hall

*Attorney, Agent, or Firm*—Robert M. McManigal

[57] ABSTRACT

Apparatus for successively attaching terminals to stripped ends of electric conductors which are delivered from a wire cutting and insulation stripping apparatus to a conductor supply zone in which the conductors are successively picked up by gripping jaws of finger assemblies carried by a conveyor chain and transported to a terminal attaching zone including successive spaced apart first and second terminal attaching devices, each having dies for crimping a terminal end portion to a received end of the conductor, and in which a conductor gripping mechanism in the terminal attaching zone is operatively controlled to axially move the conductor with a terminal attached to one end by the first terminal attaching means in a direction and for a period dependent upon its length to dispose its opposite end in a predetermined position for the attachment of a terminal thereto by the second terminal attaching device.

5 Claims, 15 Drawing Figures

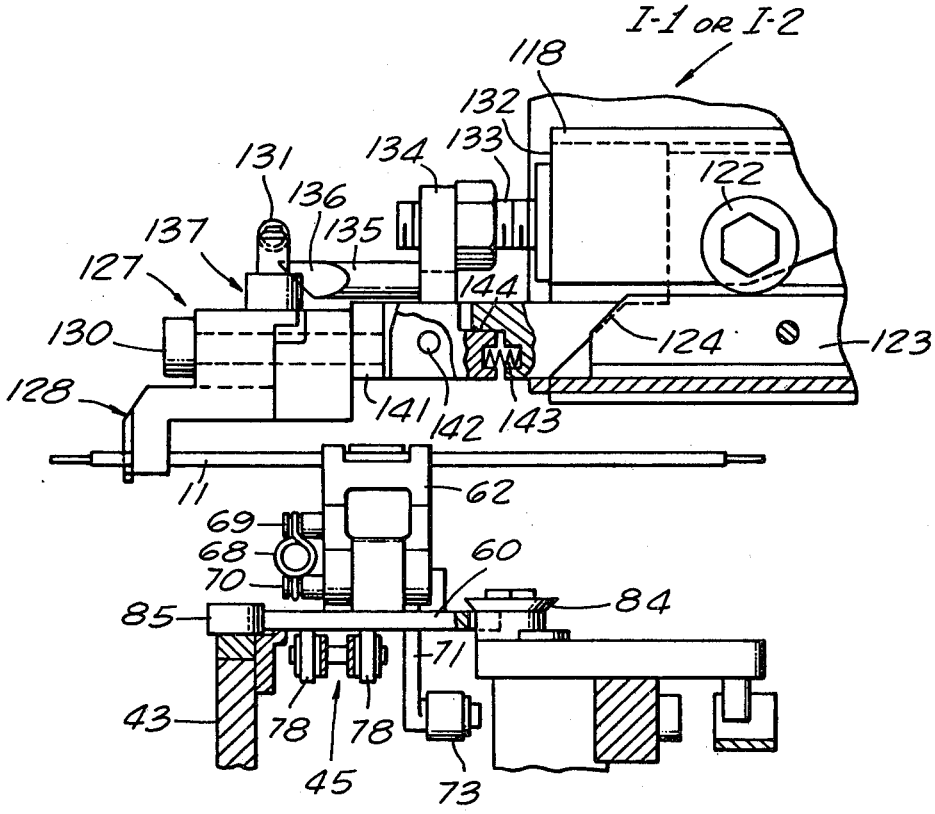
FIG. 8.
FIG. 9.
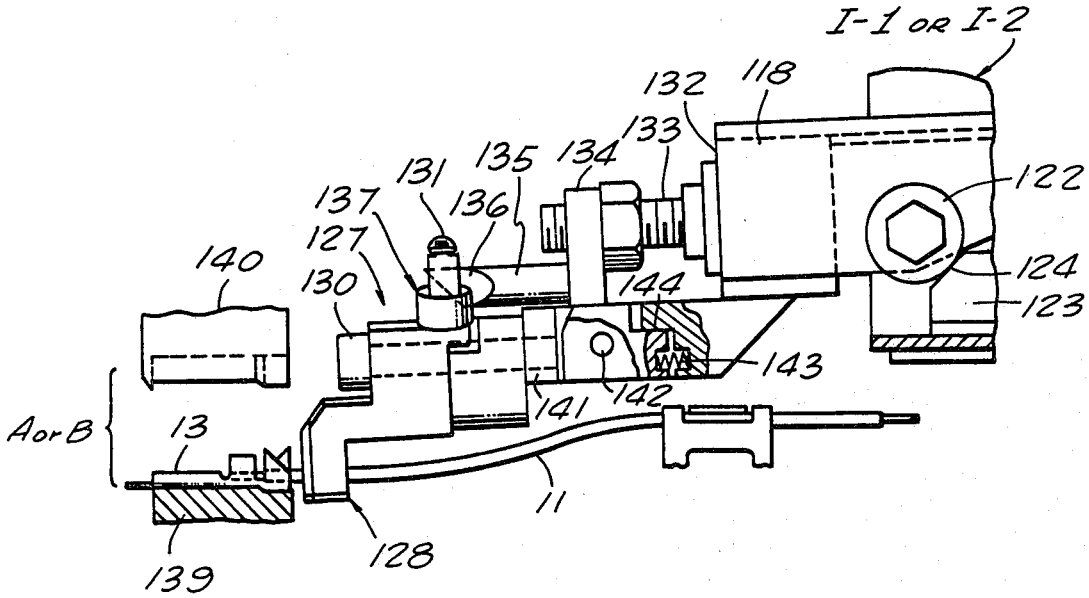

APPARATUS FOR ATTACHING TERMINALS TO THE ENDS OF ELECTRIC CONDUCTORS

BACKGROUND OF THE INVENTION

The present invention relates generally to improvements in the art of producing electric conductors with an attached end terminal.

It has been known heretofore from U.S. Pat. No. 4,244,101, which is incorporated in this application by reference, to provide a conveyor arrangement that is attached to and cooperatively associated with a conventional type high speed wire cutter and insulation stripping apparatus wherein a stripped conductor is delivered to a supply zone where it is picked up by conveyor carried gripping jaws of a finger assembly and transported to a wire inserter device in a terminal attaching zone for axially moving the stripped conductor in a manner to position one of its stripped ends in a wire receiving portion of a terminal for attachment thereto by means of an associated conventional terminal attaching device.

In the above mentioned patent, the disclosed apparatus is limited to use in those operations where a single terminal is to be attached to one end only of an electric conductor. Thus, only a relatively small axial movement of the conductor is required during the operation. This movement is readily achieved in this case by the wire inserter device which inserts the stripped end of the conductor into the receiving end portion of the terminal that is to be attached The present invention differs from that of the above mentioned patent in that it is arranged to attach terminals to both ends of the predetermined conductor length which may be in some cases of the order of ten feet more or less.

An important feature of the present invention resides in the provision of a back feed and control sensing switching means which are positioned in the conveyor path of movement of the conductor between a first terminal attaching device for attaching a terminal to one end of a conductor and a second terminal attaching device for attaching a terminal to the other end of the conductor.

The control sensing switching means comprises a pair of laterally spaced switches respectively having sensing actuating elements positioned in the path of movement of the conductor with a terminal attached at one end. When the conductor is of such length that both sensing elements are engaged, a pair of gripping rollers are activated into gripped relation with the end of the conductor having the terminal thereon, and are rotatably motivated at a relatively high speed to move the conductor lengthwise in a direction to move the other end of the conductor towards a position for attachment of a terminal thereto by the second terminal attaching device. Longitudinal movement of the conductor continues until the other end of the conductor is moved past the sensing element of the first switch whereupon the sensing elements of the switches will operatively coact to reduce the speed of movement of the conductor by the gripping rollers, until the other end is moved past the sensing element of the last switch, whereupon the operation of the feed rollers will be terminated and a braking force applied to terminate the longitudinal movement of the conductor. Lateral movement of the conyeyor then carries the conductor and the conductor end without a terminal thereon to the second terminal attaching device where the second terminal is attached.

SUMMARY OF THE INVENTION

The present invention is more particularly concerned with the production of improved apparatus for attaching terminals at the ends of electrical conductors.

It is one object of the present invention to provide an improved and more reliable apparatus for the high speed production of electric conductors of predetermined lengths and for the attachment of terminals respectively to their opposite ends.

A further object is to provide apparatus for attaching terminals to the opposite ends of a conductor by means of successive spaced terminal attaching devices wherein a terminal is first attached to one end, and a sensing and feeder device operates to longitudinally move the conductor with the terminal attached to one end into a position in which the next terminal attaching device is operative to attach a terminal to the other end of the conductor.

A further object is to provide apparatus according to the foregoing object in which the sensing and feeding device is designed to feed relatively long conductors initially at a fast speed and thereafter at a relatively slower speed as the end portions of said other end is approached.

Another object is to provide apparatus for successively attaching terminals to the opposite ends of a conductor in which laterally spaced switching elements are positioned to sense the conductor along its longitudinal axis after a terminal has been attached to one end, the switches being arranged to control the operation of gripping rollers in a manner to back feed the conductor in a direction to bring the nonterminated end into a predetermined position for attaching a terminal thereto, the sensing switches being arranged to control the rollers for a fast feed operation when both switches sense the conductor, and at a slow speed operation when one switch senses the conductor, and upon longitudinal movement of the conductor to a nonsensing position with respect to said one switch being operative to terminate the back feed of the conductor by said rollers.

Still another object resides in the provision of means for accurately positioning conductor conveying gripping finger assemblies at the conductor supply zone and terminal attaching zone, and simultaneously locking the conveyor against longitudinal movement respectively at a conductor pick-up position in the supply zone at first and second terminal affixing positions, and at a position between the terminal affixing positions for moving the conductor endwise.

It is also an object to provide apparatus according to the preceeding object, in which means are operable, at the position for moving the conductor endwise, for slightly opening the conductor gripping finger assembly to enable the endwise movement of the conductor therein.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 8 is an enlarged fragmentary elevational view of the left end of the conductor insertion device, and showing its wire gripping fingers engaged with the conductor in the terminal attaching zone;

FIG. 9 is a view similar to that of FIG. 8, except that the wire gripping fingers have been shifted to the left and downwardly to displace the conductor end out of the conductor axis and into the side opening of a terminal barrel of a terminal in an associated terminal attaching device;

DESCRIPTION OF THE PREFERRED EMBODIMENT

Figure 1:
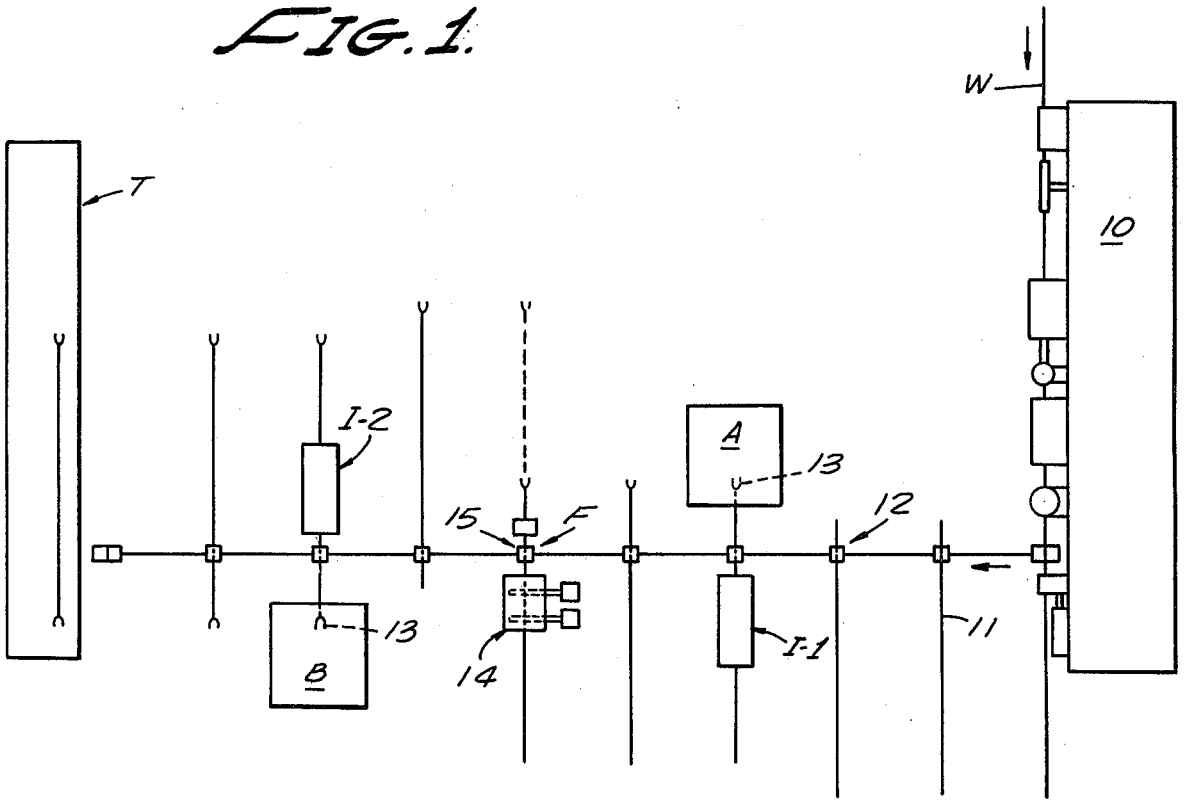
FIG. 1 is a view diagramatically illustrating the sequence of operations according to the present invention.
Figure 10:
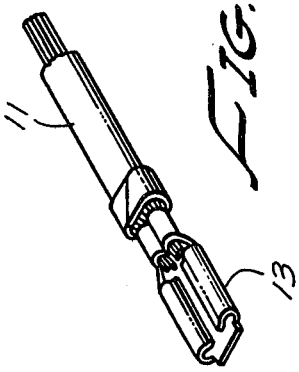
FIG. 10 is a perspective view showing a terminal attached to one end of an electric conductor by means of the apparatus of the present invention.

As shown more specifically in the drawings, the apparatus of the present invention as diagramatically illustrated in FIG. 1 comprises a wire cutter and insulation stripping apparatus, as generally indicated at 10, which is adapted to receive an insulated wire W, cut it into predetermined conductor lengths 11 having insulation stripped opposite ends. These conductors are then transported by an associated conveyor mechanism, as generally indicated at 12, from a conductor supply zone to terminal attaching zones wherein a terminal 13 will be attached to each end of the conductor 11, as shown in FIG. 10.

In the terminal attaching zone, a conductor insertion device I-1 is operative to insert the following end of the conductor into a first terminal attaching device A. The conductor 11 with the attached first terminal is then conducted to a back feed device, as generally indicated at F wherein sensing switch control means 14 are operative to control the operation of feed roller means 15 in a manner to back feed the conductor in a reverse direction to bring its leading end into an appropriate position for the attachment of a terminal to this end of the conductor.

After the conductor has been longitudinally moved by the back feed device F, the conductor is then transported by the conveyor to a second terminal attaching device B where a conductor insertion device I-2 is activated to move this end of the conductor into the associated terminal attaching device B for the attachment of a terminal thereto.

After the attachment of the second terminal, the conductor with terminals attached to its respective opposite ends is then conducted by the conveyor to a discharge position where it is deposited in a collecting trough T.

Figure 2:
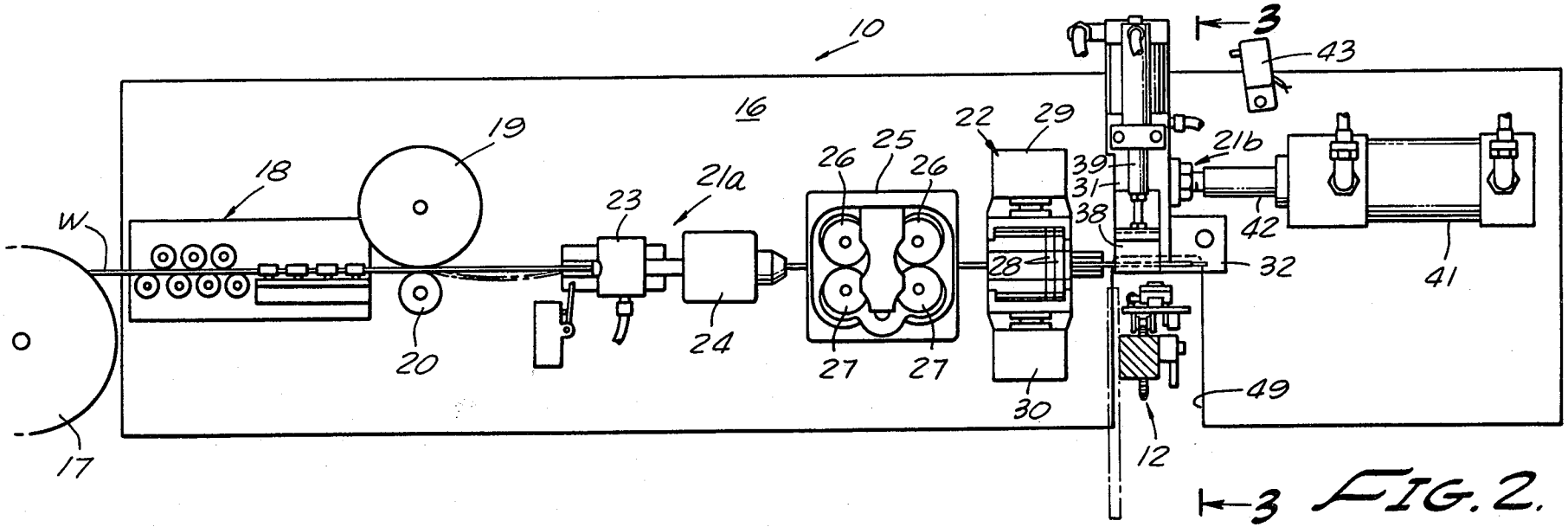
FIG. 2 is a front elevational view of a wire cutter and insulation stripping apparatus as embodied in the present invention and which supplies the conductor lengths which are to have terminals attached to the opposite ends thereof.

More specifically as best shown in FIG. 2, the cutter and stripping apparatus 10 may vary as to details of construction, but basically comprises conventionally known apparatus which is illustrated as embodying a main panel 16 upon which the various components are mounted. The wire W is fed from the left end of the panel 16 from a supply reel 17 or other suitable source into a wire straightening device 18 of conventional construction, and thence to a length measuring mechanism which includes a measuring wheel 19 that is operatively associated with a presser wheel 20, the measuring wheel being associated with a cycling control for determining the sequence of operation of the cutter and stripping mechanisms.

The measured wire is conducted to a first stripping mechanism 21*a* which is positioned on the feed side of a wire cutting mechanism 22 and includes pneumatically operable means 23 for the controlled gripping of the wire W during a stripping operation in response to movement by means of a pneumatically energizable cylinder-piston actuator 24 in a manner well known in the art.

The wire W then passes through a feeding mechanism 25 between a set of upper rollers 26 and lower rollers 27, these rollers being arranged for actuation into feeding engagement with the wire, and to a slightly separated position in which the feeding of the wire will be terminated.

From the feeding mechanism, the wire is conducted to the cutting mechanism 22, wherein a series of blades 28, are operable in a well known manner by means of upper and lower cylinder-piston actuators 29 and 30 to completely sever the wire and cut through portions of the insulation only on opposite sides of the wire cutting blade.

A second stripping mechanism 21*b* is positioned on the discharge side of the cutting mechanism and is synchronously controlled and operated in cooperative relationship to the first stripping mechanism 21*a* to remove the severed insulation portions by pulling the severed wire ends in opposite directions away from the cutting blade.

Figure 6:
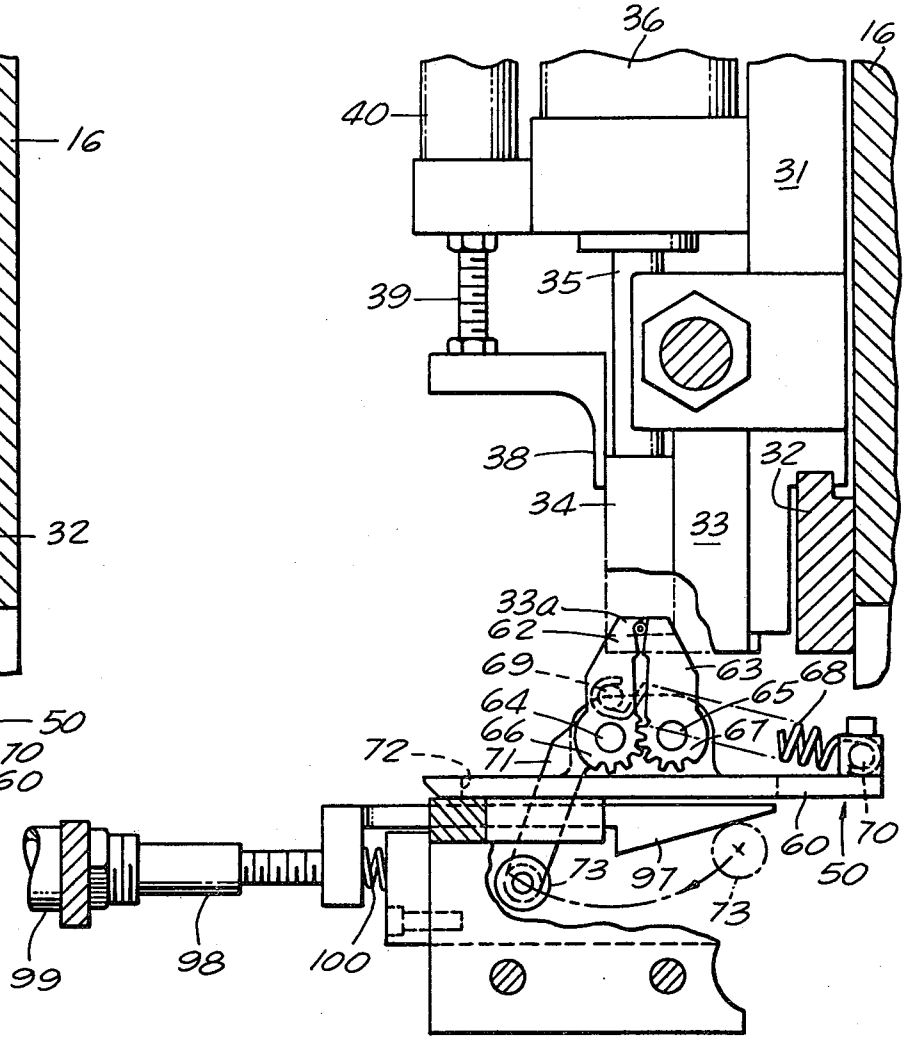
FIG. 6 is a similar view to that of FIG. 5, but showing the gripping fingers in gripped relation with the clamp supported wire conductor.
Figure 5:
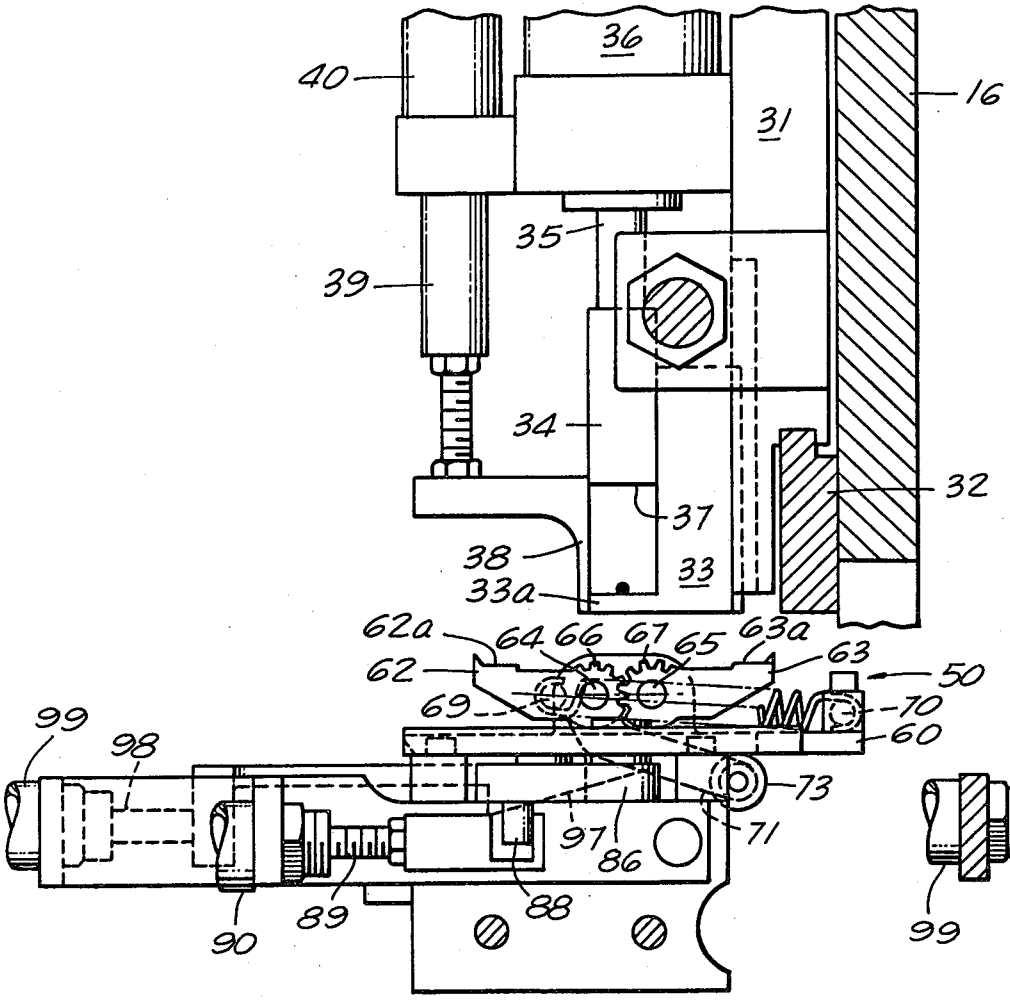
FIG. 5 is an enlarged fragmentary transverse sectional view taken through the stripping mechanism in the pick-up zone showing the wire clamping members in open position and a finger gripping assembly with its fingers in opened position below the wire conductor.

As shown, the second stripping mechanism 21*b* is mounted upon a back panel 31 which is supported for rectilinear lateral sliding movement upon a support rail 32, as best shown in FIGS. 5 and 6. The back panel 31 mounts a pair of wire engaging jaw or clamping members 33 and 34. The clamping member 33 is adjustably affixed to the back panel 31, and the clamping member 34 is connected with the piston rod 35 of an actuating cylinder 36 for reciprocable movements between an opened position of the clamping members and a closed position in which the clamping member 34 coacts with an extension 33*a* of the clamping member 33 to grippingly engage the wire.

Figure 7:
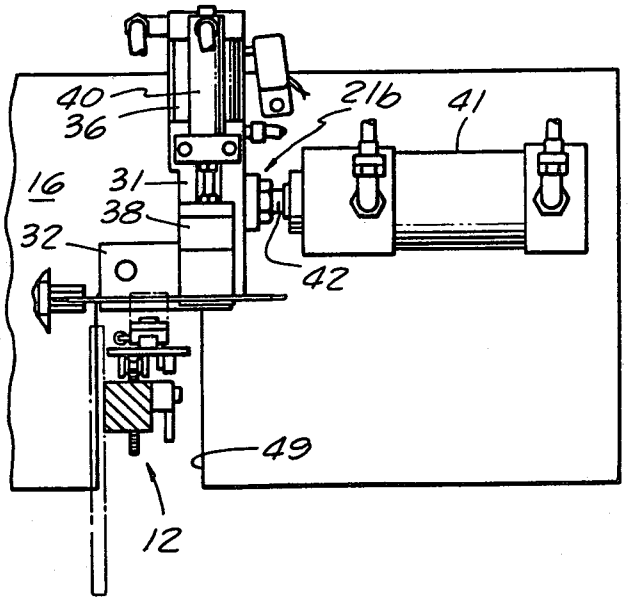
FIG. 7 is a fragmentary front elevation of the stripping mechanism in the pick-up zone, with the mechanism laterally shifted from the position shown in FIG. 2.

The second stripping mechanism 21*b* is initially positioned in close proximity to the wire cutting mechanism, as shown in FIG. 2, to receive the measured length of wire which is to be cut and stripped, the clamping members 33 and 34 being in opened position at this time and coacting to form an open sided groove 37 for guidingly receiving the wire by an axial feeding movement thereof. A gate member 38 normally closes the open side of the groove, this gate being operatively connected with a piston 39 of a control cylinder 40 by means of which the gate may be initially closed during the reception of the wire, and later opened after the second stripping mechanism 21*b* has been shifted rectilinearly to a conductor pick-up position, as shown in FIG. 7. Shifting of the second stripping mechanism 21*b* to the pick-up position is accomplished by means of an actuator cylinder 41 which is mounted on the main panel 16 and has a piston rod 42 connected with the back panel 31.

With each operation of the wire cutter and stripping apparatus, the movement of the stripping mechanism 21*b* to its stripping position, as shown in FIGS. 7 and 8, will provide a conductor 11 with stripped ends at a pick-up position in a conductor supply zone. As the stripping mechanism 21*b* is moved into the pick-up position, it will activate switch means 43 of appropriate control means to initiate a sequence of operating functions including the activation of the conveyor mechanism 12 and associated components, as will subsequently be more fully described, to pick up and transport the delivered conductor 11 to the first and second terminal attaching devices A and B where a terminal is successively attached to each end of the conductor.

Figure 3:
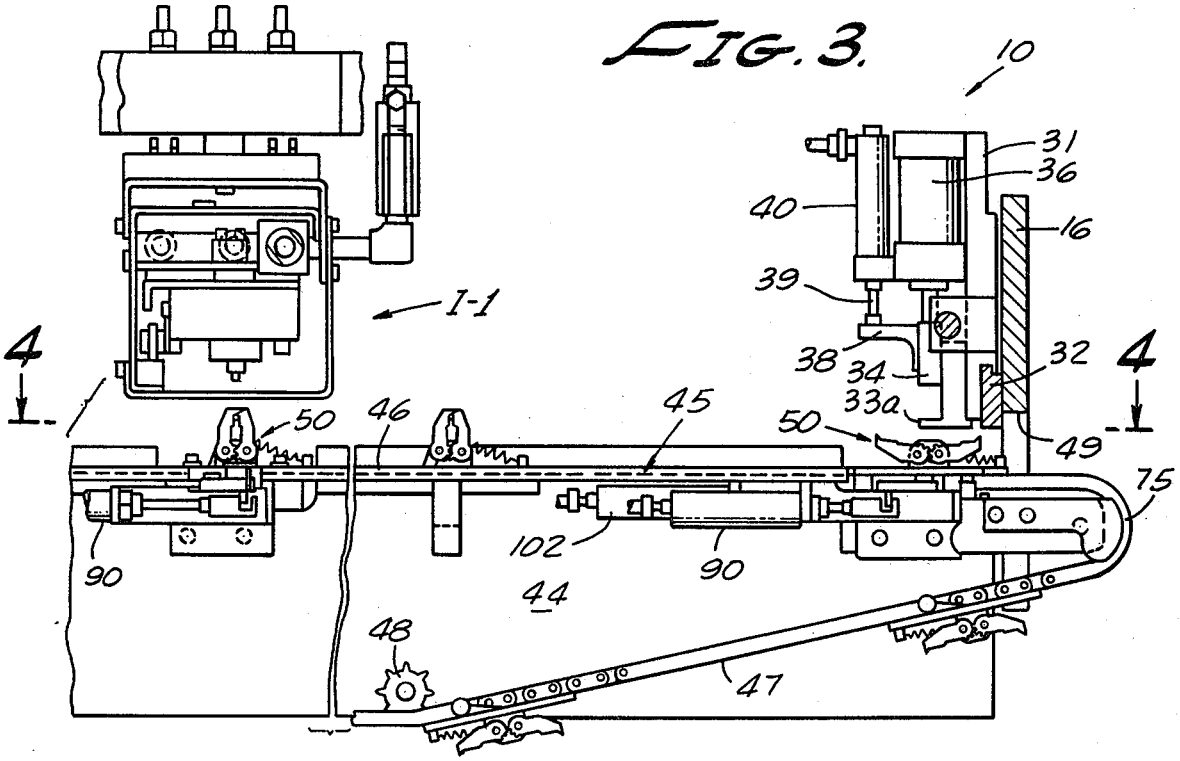
FIG. 3 is a fragmentary transverse sectional view, taken substantially on line 3—3 of FIG. 2, of the stripping mechanism at the conductor supply zone, and including an associated conveyor mechanism, as shown in side elevation, for transporting the electric conductors from the conductor supply zone to the first terminal attaching device in the terminal attaching zone.
Figure 4:
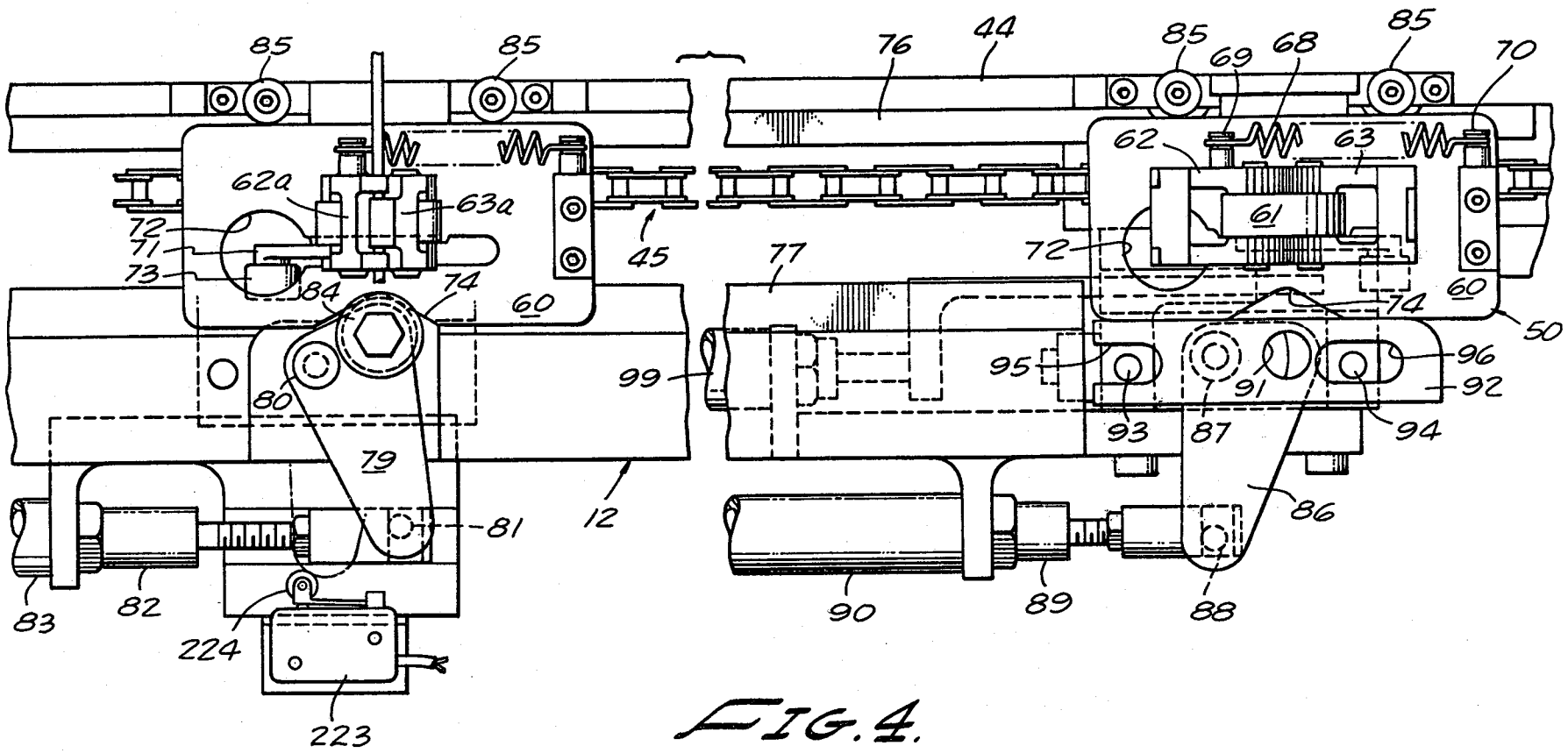
FIG. 4 is an enlarged fragmentary plan view, of the conductor conveyor with finger gripping assemblies positioned respectively in the conductor supply zone and the terminal attaching zone, and the means for accurately positioning the assemblies and locking the conveyor against movement during the conductor pick-up, the conductor back feed and the terminal attaching operations, as viewed substantially along line 4—4 of FIG. 3.

As best shown in FIGS. 3 and 4, the conveyor mechanism 12 is supported upon an appropriate frame structure, which includes an upstanding frame plate member 44, that extends forwardly of the main panel 16 in a generally normal direction thereto. On one side of this plate member there is provided a conveyor chain 45 which is looped around an idler sprocket at the outer end of the loop so as to provide a generally horizontal upper run 46, and a lower run 47 which is maintained in a widened spaced relation to the upper chain run by means of idler sprockets 48. The inner end of the conveyor, as shown in FIG. 3, has its end portion extending through an opening 49 of the panel 16. As thus arranged, the conductors 11 will be picked up by conductor gripping finger assemblies, as generally indicated at 50, attached to the conveyor chain while positioned in the horizontal upper run of the chain.

Figure 15:
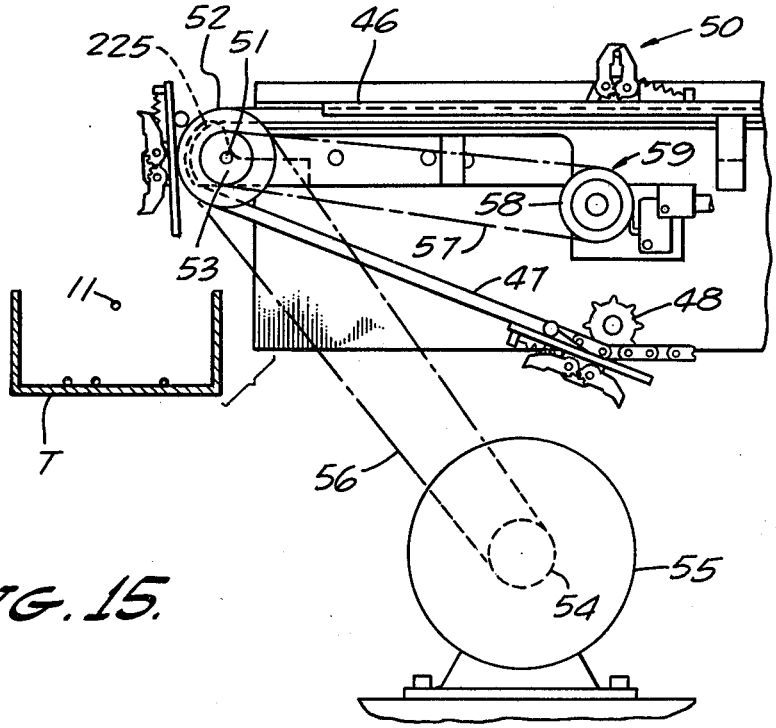
FIG. 15 is a fragmentary side elevational view of the discharge end of the conductor conveyor mechanism, and showing a trough for receiving the conductor with terminals attached to both ends thereof.

At the driving end of the conveyor chain, as shown in FIG. 15, the driving sprocket is mounted on a rotatable shaft 51 which mounts at one end a pair of pulleys 52 and 53. The pulley 52 is preferably of the toothed type and is driven from a similarly toothed driving pulley 54 of a driving electric motor 55 by means of an interconnecting toothed timing belt 56. The pulley 53 is also preferably of the toothed type and is operatively connected by a timing belt 57 with a toothed driven pulley 58 of a cam actuated switch assembly, as generally indicated at 59. This switch assembly comprises a plurality of control switches which are operable in combination with other components of the control system to synchronously coordinate the operations of certain parts of the apparatus. For example, one of these switches may be utilized to stop the driving motor 55 and apply its brake in order to properly locate the finger gripping assemblies 50, respectively, at the pick-up position in the conductor zone and the terminal attaching zone. Another of these switches may be utilized to control means for locking the finger gripping assembly in the terminal attaching zone against movement. The remaining switch may be utilized to coordinate the operations of the conveyor and the return of the second stripping mechanism 21*b* to its initial conductor receiving position.

The construction of the finger gripping assemblies is best shown by reference to FIGS. 4, 5 and 6. As will be seen, the assembly is mounted upon a carrier plate 60 of generally rectangular configuration and is conformed to provide a central mounting block 61 for a pair of conductor gripping finger members 62 and 63. These fingers are of generally U-shapped construction and have their innermost ends in straddling relation to the block 61 and adjacently pivotally mounted on transversely extending pivots 64 and 65. The outer ends of the fingers are formed with conductor gripping jaw faces 62*a* and 63*a*, respectively. The pivoted ends of the fingers are provided with intermeshing sector gear portions 66 and 67 which coact to tie the fingers together for unitary movement between a non-gripping opened position extending along the carrier plate in substantially opposed 180° relation, and in a closed gripping position in substantially 90° relation to the carrier plate. In moving between the opened and closed positions, the fingers are arranged to pass through an overcenter position with respect to a tension spring 68 which is shown as having one end connected with a projecting stud 69 on the finger member 62, and its other end anchored to a stud 70 secured to the carrier plate 60. As thus arranged, the fingers will be resiliently urged towards their opened and closed positions. Opening and closing of these fingers is accomplished by means of an actuating arm 71 which is integrally formed with the finger member 62 and extends through an opening 72 to the opposite side of the carrier plate 60, and at its outer end mounts a roller 73. This roller, as shown in FIG. 5, is adapted to engage against the adjacent face of the carrier plate 60, when the finger members are in opened position. As best seen in FIG. 4, the carrier plate 60 is provided at its longitudinal center with a V-shaped edge notch 74, for a purpose which will hereinafter be explained.

As shown in FIG. 3, the finger gripping assemblies 50 are in spaced relation on the conveyor chain such that a finger assembly will be concurrently positioned in the conductor supply zone and in the terminal attaching zone. The finger assemblies in the lower run 47 of the conveyor will ordinarily be in their opened position, due to its having discharged a conductor with the affixed terminals at the discharge end of the conveyor. However, if a finger assembly should for some reason be in a closed position, the actuating arm 71 will then occupy a position as shown in full lines in FIG. 6, wherein the roller 73 will be substantially spaced from the carrier plate 60. In this case, a camming member 75 at the inner end of the conveyor loop will engage the roller 73 and move the closed gripping fingers towards an open position through dead center, whereupon the spring 68 will function to urge the fingers into an open position for movement into the conductor pick-up position at the supply zone.

At the proper position of the finger assemblies in the supply zone and terminal attaching zone, appropriate controls will disconnect the motor 55 and apply its brake to stop the chain movement. A unique feature resides in the provision of means for locking the conveyor chain in the stopped position and for clampingly laterally securing the finger assemblies in their proper positions, respectively, in the supply zone and terminal attaching zones with respect to a pair of laterally spaced rails 76 and 77 upon which the carrier plates of the finger assemblies are slidably supported during movement in the upper run of the chain conveyor, the chain 45 being connected with each of the carrier plates 60 by means of lugs 78, as shown in FIG. 8.

As shown in FIG. 4, the locking operation is accomplished by means of a rocker arm 79 which is swingably mounted upon a fixed pivot 80. The rocker arm has an actuating pivotal connection 81 with a reciprocable piston rod 82 that is operatively associated with a power cylinder 83. The rocker arm also carries a roller 84 which is adapted to seat in the edge notch 74 and longitudinally accurately center the finger assembly 50 in relation to the terminal attaching mechanism. The actuation of the rocker arm also functions to laterally move the carrier plate 60 into clamped engagement against a pair of spaced positioning rollers 85 which are appropriately supported in the top portion of the plate frame member 44.

Simultaneously with the locking operation of the finger assembly 50 in the terminal attaching zone, a somewhat similar arrangement is provided for clamping the finger assembly 50 that is in the supply zone against the positioning rollers 85 at this location. For this purpose, a rocker arm 86 is supported for pivotal movement on a fixed pivot 87. This rocker arm has one pivotal connection 88 with a reciprocating piston 89 of a power cylinder 90. The rocker arm also has a pivotal connection 91 with a presser bar 92 which is mounted for limited longitudinal and transverse movements by means of a pair of spaced pins 93 and 94 respectively positioned in slots 95 and 96. As thus arranged, it will be apparent that energization of the power cylinder 90 will operate to swing the rocker arm 86 about its pivot and force the presser bar 92 against the adjacent edge of the carrier plate 60 in a manner to cause it to clampingly engage against the positioning rollers 85 and thus positively hold this finger assembly in a proper position for picking up the conductor in the supply zone.

As previously explained, the finger members 62 and 63 of the finger assembly 50 as thus clampingly positioned, will be in an opened position as shown in FIG. 5. Closure of the finger members 62 and 63 is accomplished by means of a reciprocably mounted tapered linear cam member 97 which is supported for reciprocal movement in a path between the roller 73 on the actuating arm 71 of the finger assembly and the adjacent face of the carrier plate 60 as shown in FIG. 5. The cam 97 is operatively connected with a piston rod 98 of a power cylinder 99. When the power cylinder is energized, the cam 97 will be moved between the roller 73, as shown in phantom lines, and the carrier plate 60, and by this action the roller 73 will be moved past a dead center position of the finger members 62 and 63, whereupon the spring 68 will urge the fingers into a wire clamping position, as shown in full lines in FIG. 6. A compression spring 100 is provided to return the cam member to an inactive position, when the power cylinder 99 is deenergized.

At the terminal attaching zones, the end of the conductor 11 to which the terminal is to be applied is positioned in each case in the receiving barrel portion of the terminal by means of similar first and second wire insertion devices, as generally indicated at I-1 and I-2 in FIG. 1. Each of the wire insertion devices is constructed in detail as completely shown in U.S. Pat. No. 4,244,101 and is mounted in a position above the finger gripping assembly 50 that clampingly supports the conductor 11 therein. As best shown in FIGS. 8 and 9, the wire insertion device comprises a sub-carriage 118 that is reciprocally movable longitudinally and pivotally mounted at its inner end to enable swinging movement in a clockwise direction under the urging force of a compression spring (not shown). This swinging movement is normally opposed during initial reciprocable movement towards the left, by means of a roller 122 which is normally in rolling engagement with the upper surface of a cam bar 123 which is provided at one end with an inclined surface 124. Upon continued leftwise movement of the sub-carriage, the roller 122 will ride over the inclined surface 124 and thereby enable pivotal movement of the sub-carriage under the action of the spring so as to swing the left end of the sub-carriage from a horizontal axis of movement downwardly to an inclined angularly extending position as shown in FIG. 9. The point at which the swinging movement of the sub-carriage occurs is adjustable by varying the longitudinal position of the cam bar 123.

The sub-carriage 118 supports a conductor gripping finger assembly, as generally indicated at 127, which is normally positioned over the conductor at the terminal attaching zone and has a pair of wire gripping fingers 128 that are swingably supported upon a pivot 130 for movement into gripping and non-gripping relation to the conductor 11. The fingers 128 are interconnected above pivot 130 at their uppermost ends by a tension spring 131 which normally acts to spread the wire gripping ends of the fingers into a separated non-gripping position. Movement of the fingers 128 into gripping relation on the conductor 11 is accomplished by means of a power cylinder 132 which has its piston rod 133 connected to a supporting bracket 134 for a wedge pin 135 having a tapered end portion 136 that is adapted to extend between a pair of rollers 137 respectively mounted on the upper ends of the fingers 128, and upon actuation force the open fingers into gripped relation with the conductor 11 which is at this time being held by the finger gripping assembly 50 at the terminal attaching zone.

After the fingers 128 are in gripped relation with the conductor 11, the wire insertion device will be energized by the actuation of suitable controls to shift the sub-carriage 118 and the finger assembly 127 as a unit to axially move the gripped conductor 11 endwise of the gripping finger members 62 and 63 of the finger gripping assembly 50 so as to position the stripped end of the conductor in a proper relationship to the wire receiving portion of a terminal 13 positioned on an anvil 139 of the terminal attaching mechanism A or B, this anvil being operatively associated with a crimping die 140. If the terminal has a closed sleeve wire receiving portion, the travel of the roller 122 on the cam bar 123 will be limited to the linear edge portion of the cam bar 123 so that the endwise movement of the conductor (11) will be substantially horizontal and the end of the conductor will be inserted endwise directly into the closed sleeve of the terminal. In the event that the terminal has an open sleeve, the cam bar 123 will be adjusted so that the roller 122 will initially move the gripped conductor horizontally to a position in which its end is disposed above the open barrel of the terminal, and upon further movement will pass over the inclined surface 124 and let the sub-carriage pivotally move to deflect the end of the conductor laterally into the receiving barrel of the terminal, as shown in FIG. 9. When the stripped end of the conductor is positioned in the receiving portion of the terminal, appropriate controls will operate to cause the movement of the die 140 to crimp the terminal to the conductor end in a manner well known in the prior art.

The conductor gripping finger assembly 127 is also arranged for independent pivotal movement with respect to the associated sub-carriage 118 in order to initially elevate the wire gripping fingers 128 and provide greater clearance for the passage of the conductor 11 as it is being moved into the terminal attaching zone. For this purpose, the conductor gripping finger assembly 127 is mounted upon an arm extension 141 which is pivotally connected to an adjacent portion of the sub-carriage 118 by a suitable pivot 142. A compression spring 143 normally acts to urge the arm 141 towards a raised position of the conductor gripping finger assembly 127 above the conductor 11. In the non-raised or horizontal position, the pivotal movement of the arm 141 in a counter-clockwise direction is limited by the engagement of abutment shoulders at 144 of the arm and the sub-carriage, as best shown in FIG. 8.

Once the terminal has been affixed to an end of the conductor 11 at a terminal attaching zone, the timing control will reset the wire insertion device by retracting the piston rod 133 and by moving the sub-carriage 118 back to its retracted position, as shown in FIG. 8 and at the same time energize the power cylinders 83 and 90 to unlock the conveyor chain and permit its movement to bring the next conductor finger gripping assemblies 50 respectively into position at the supply zone and terminal attaching zones.

Referring again to FIG. 1, it will be seen that after a terminal has been affixed to one end of conductor 11 by means of the first terminal attaching device A, it is necessary to longitudinally move the conductor 11 in order to bring its opposite end into a proper orientation for the attachment of a terminal thereto by means of the second terminal attaching device B. This is accomplished by means of the conductor back feed device, which will now be described.

Figure 11:
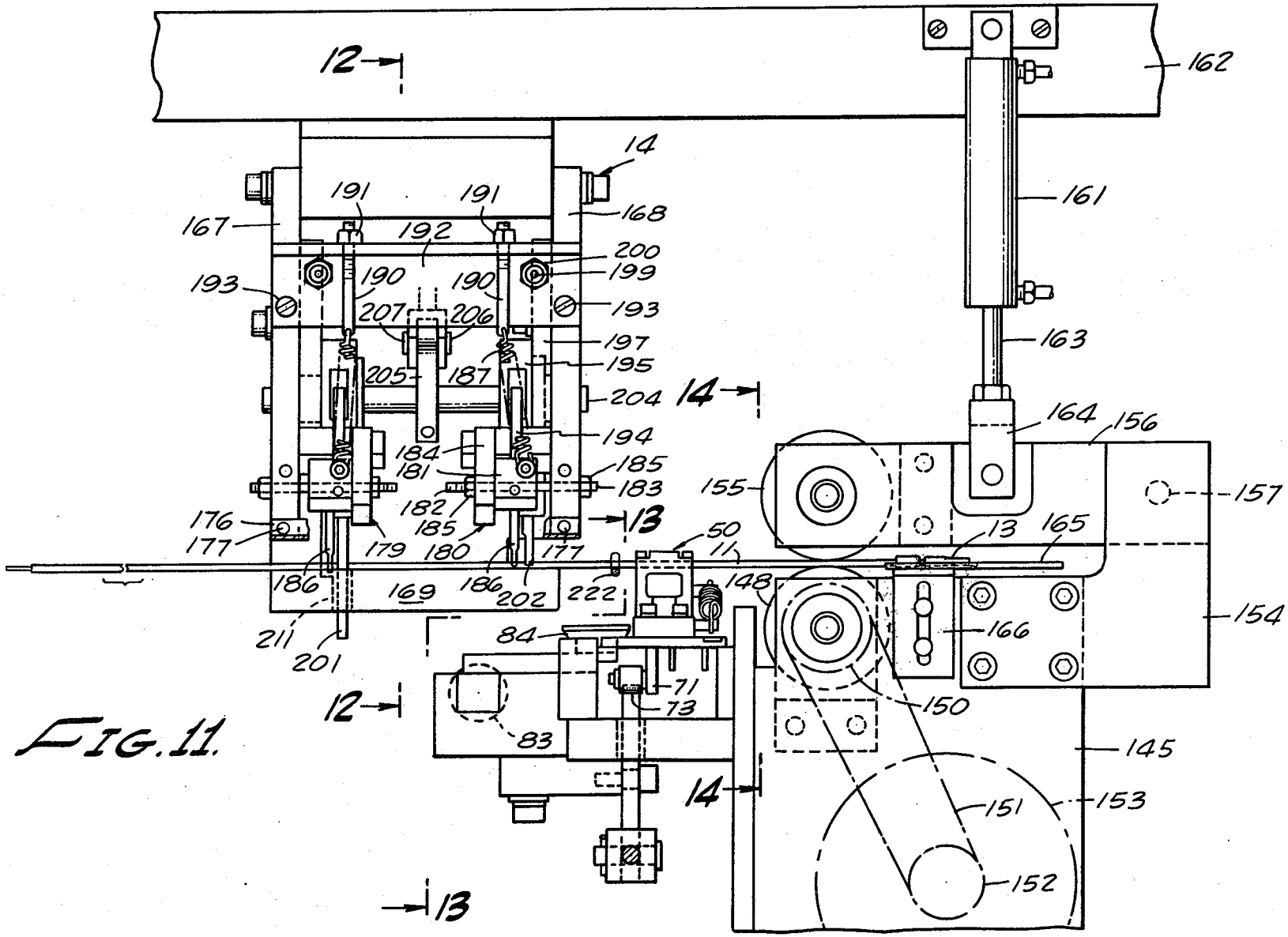
FIG. 11 is a transverse elevational view showing details of the conductor back feed device and conductor sensing control switches for axially longitudinally moving the conductor with a terminal affixed to one end to a position for affixing a terminal to its opposite end.
Figure 14:
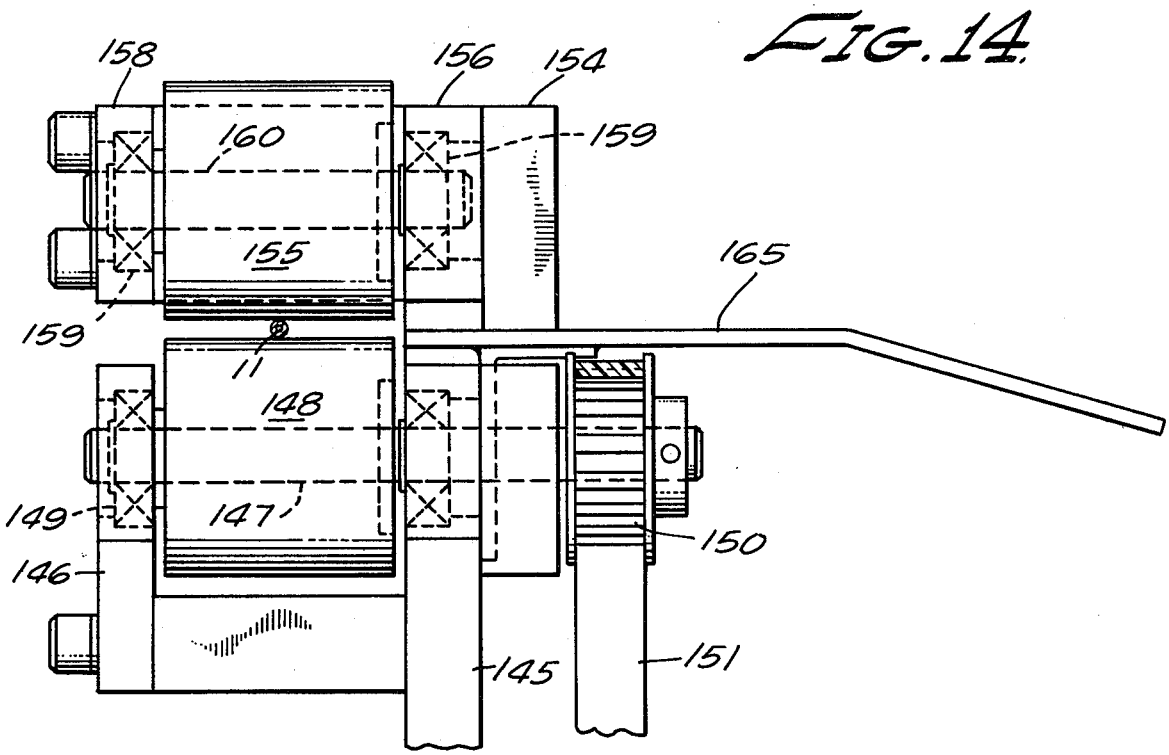
FIG. 14 is a fragmentary elevational view as seen substantially along line 14—14 of FIG. 11, showing details of the conductor back feed rollers.

The back feed device, as disclosed in FIG. 11, comprises feed roller means 15 which is positioned on the same side of the conveyor path as the first terminal attaching device A, and a sensing switch control means 14 which is positioned on the opposite side of the conveyor feed path. As best shown in FIGS. 11 and 14, the feed roller means comprises a fixed frame structure which includes a mounting plate 145 and a spaced plate 146 which co-act to support the shaft 147 of a rotatable driven roller 148 in appropriate bearings 149. A drive pulley 150 is secured to this shaft and has a driving connection by means of a timing belt 151 with a drive pulley 152 of a driving motor 153.

A bracket 154, which is secured at one end to the mounting plate 145, provides a support for a movable upper idler feed roller 155. For this purpose, an arm 156 is pivotally connected at one end for swinging movement on pivot 157. This arm carries an outer side frame 158 with which it collaborates to provide a support for suitable bearings 159 for a supporting rotatable shaft 160 of the upper feed roller. The upper feed roller 155 is arranged to be moved into feeding and non-feeding relation with respect to the driven roller 148 by suitable actuating means which in this case comprises an air cylinder 161 which is pivotally connected at one end to a supporting frame structure 162 and has a piston 163 connected with the arm 156 by means of a clevis 164. A guideplate 165 is supported on a bracket 166 which is adjustably secured to the mounting plate 145 and serves to guide the adjacent end of the conductor 11 and affixed terminal 13 to a position between the disengaged rollers 148 and 155.

Figure 12:
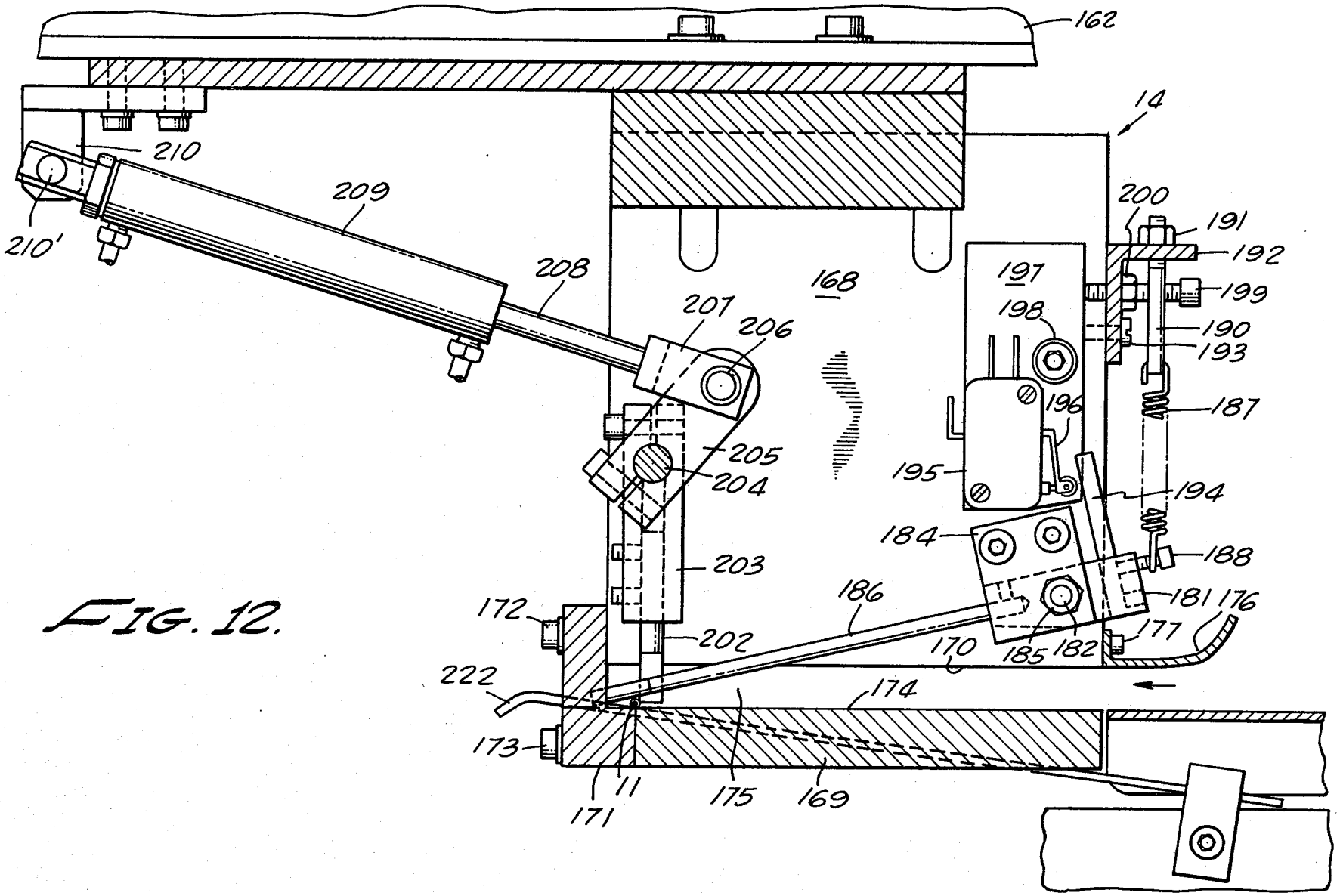
FIG. 12 is a fragmentary transverse sectional view taken substantially on line 12—12 of FIG. 11, and showing details of the raker means and switch sensing means.

Having reference now to FIGS. 11 and 12, the sensing switch control means 14 is disclosed as comprising a boxlike frame structure which is suspended from the supporting frame structure 162 and comprises a pair of laterally spaced substantially rectangular wall forming plate members 167 and 168. A platform 169 is supported in spaced relation below the bottom edges 170 of these plate members by means of a transversely extending connector plate 171 which is secured as by holding screws 172 to the plate members 167 and 168, and holding screws 173 to the platform 169. As thus mounted, the upper surface 174 of the platform and the bottom edges 170 of the side plate members define a movement channel 175 for the passage of the entering conductor 11. Movement of the conductor into this channel is guided by a transversly extending upper guide member 176 which is secured to the forward edges of the members 167 and 168 as by suitable holding screws 177. A lower guide member 178 guides the conductor onto the upper surface of the platform 169.

The plate members 167 and 168 respectively mount (the) laterally spaced switch assemblies 179 and 180 for sensing the movement of the received conductor 11 into a position between the open rollers 148 and 155. The switch assemblies cooperatively function to control the back feed speed of the conductor in such a manner that: (a) in the case of a long conductor both switches will be activated to control the energization of the motor 153 so as to drive the rollers and move the conductor 11 at a relatively high speed (b) when the trailing end of the conductor 11 leaves the switch assembly 179, switch assembly 180 will operate to decrease the motor speed so as to move the conductor 11 at a slower speed, and (c) when the trailing end of the conductor leaves the switch assembly 180, the driving motor 153 will be de-energized and dynamic braking applied to position the trailing end of the conductor at a proper position for subsequent movement by the conveyor to the second terminal attaching device B.

The switch assemblies 179 and 180 are similarly constructed, and each switch assembly comprises a block member 181 that is swingably supported between the adjacent ends of axially aligned adjustable pivots 182 and 183 respectively mounted on an inwardly spaced frame plate 184 and associated plate member 167 or 168. As thus mounted, the position of the block 181 may be laterally shifted to change its plane of swinging movement, and thereafter the adjusted pivot members may be locked in adjusted position by means of an associated lock nut 185, in each case. The block 181 mounts an elongate rod-like sensing arm 186, the outer end of which is normally disposed in the channel 175 in the path of movement of the conductor 11 therein as it approaches a final position. The sensing arm 186 is biased towards this normal position by means of a tension spring 187 which is attached at one end to the block 181 by a screw 188. The opposite end of the tension spring is connected with one end of a rod member 190 which is threaded for connection with a securing nut 191, when this end is mounted in a receiving opening of an angle frame member 192 extending between and connected at its ends to the side plates 167 and 168 respectively by mounting screws 193. A switch actuating pin 194 is mounted on the opposite side of the pivot of the block 181 from the sensing arm 186 and extends in right angle relation thereto.

A micro-switch 195 has an actuator 196 that is positioned in the path of movement of the outer end of the switch actuating pin 194. The switch 195 is supported upon a frame plate 197 which is swingably secured to the adjacent frame plate 167 or 168 by means of a pivot bolt 198. An adjusting screw 199 threadedly mounted on the angle frame 192 has its inner end engaged with the frame plate 197 and serves to enable adjustment of the pivotal position thereof and hence the relationship of the actuator 196 with respect to the switch actuating pin 194. The desired adjusted position may then be maintained by tightening the pivot bolt 198 and tightening a lock nut 200 on the adjusting screw 199. Normally this adjustment will be such that the tension spring 187 will bias the actuating pin 194 so as to move the actuator 196 to one switch operative position, when there is no conductor 11 present. However, movement of a conductor into engagement with the sensing arm 186 will move the actuating pin 194 to a position that will enable movement of the actuator 196 to another switch operative position.

The apparatus of the present invention may be utilized to attach terminals to the opposite ends of conductors which may vary from relatively short lengths to longer lengths of conductor of the order of ten feet in some cases. Thus, when a long conductor is carried by a gripping finger assembly 50 into the sensing switch control 14, the drag on the unterminated end of the conductor 11 may curve it so much that there will be a tendency to activate the switch assembly 180 ahead of the actuation of the switch assembly 179. Also, particularly in the case of relatively small conductors, the force of engagement of the conductor against the sensing arms 186 may not be sufficient to overcome the biasing forces of the springs 187 and thereby activate the associated micro-switches 195. It is, therefore, an important feature of the present invention to provide means for assuring that the conductor will engage each of the sensing arms 186 with a force sufficient to operate the switch assemblies. For such purpose, a long raker arm 201 is operatively associated with the sensing arm 186 of switch assembly 179, and a short raker arm 202 is operatively associated with the sensing arm 186 of switch assembly 180. Each of these raker arms is connected by means of an end clamp 203 to a rocker shaft 204 which has its respective ends rotatively supported in the frame plate members 167 and 168. An actuating crank arm 205 is clampingly secured to the shaft 204 intermediate its ends, the outermost end of this crank being connected by a pivot pin 206 of a clevis 207 carried by a piston rod 208 which extends from one end of a double-acting air cylinder 209. The other end of this cylinder is swingably connected to a fixed bracket 210 on the supporting frame structure 162 by means of a pivot pin 210'. The long raker arm 201 has a swinging path of movement which includes a slot 211 in the platform 169. As thus arranged, energization of the cylinder 209 to retract the piston rod 208 will swing the raker arms 201 and 202 into a raised position above the path of travel of the conductor 11 in the channel 175 towards its final position. Energization of the cylinder 209 to extend the piston rod 208 will then operate to swing these raker arms in an opposite direction to a position, as shown in full lines in FIG. 12, in which the raker arms will force the conductor 11 into operative engagement with the sensing arms 186 of the switch assemblies.

Figure 13:
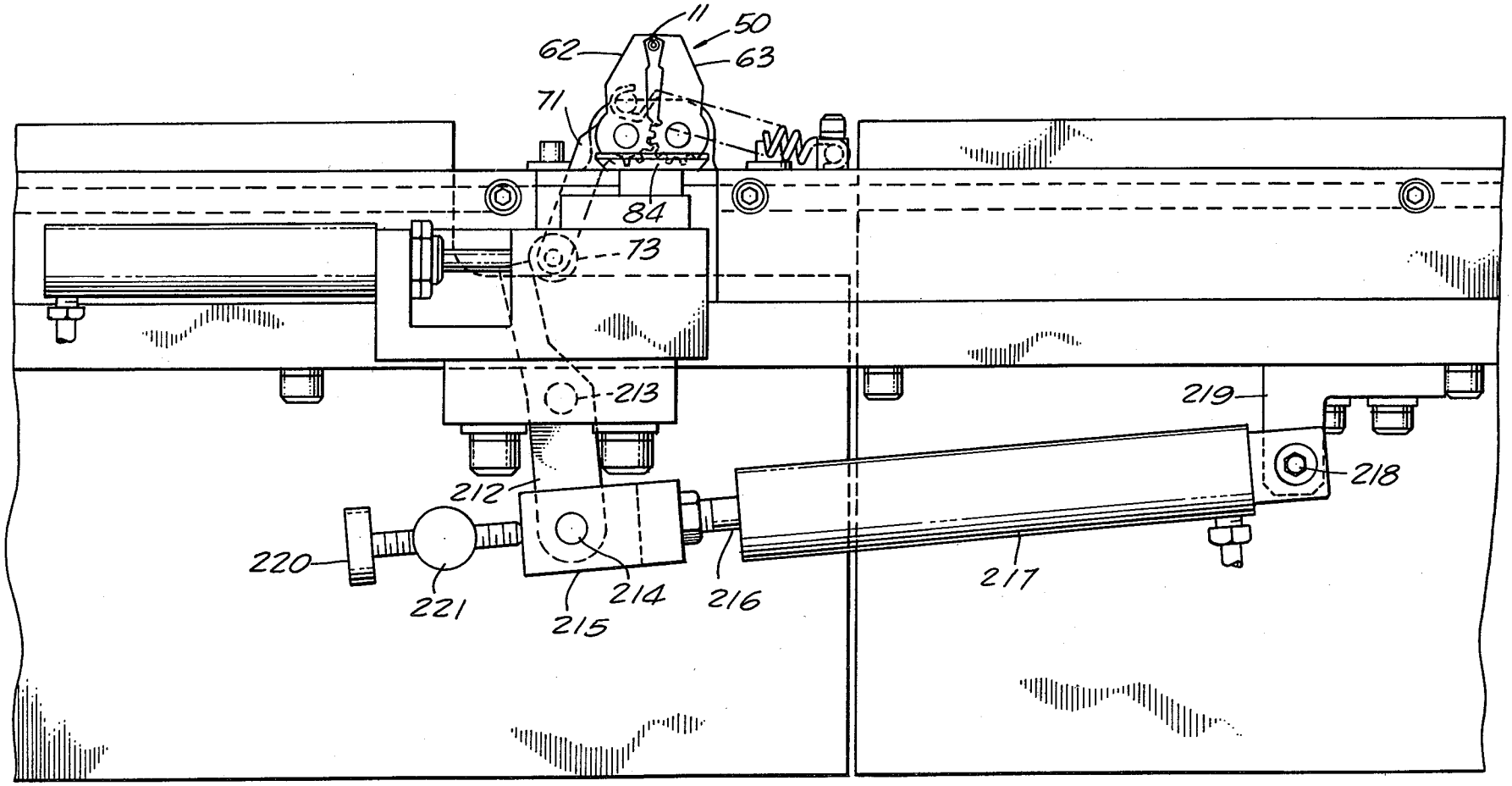
FIG. 13 is a fragmentary elevational view, as seen substantially along line 13—13 of FIG. 11, showing details of the pneumatically actuated means at the back feed position for slightly opening the conductor gripping fingers.

Upon delivery of a conductor 11 to the back feed device F, the conductor 11 will initially be firmly gripped between the conductor gripping finger members 62 and 63. In order to permit back feed movement of the conductor in the gripping fingers, it will, of course, be necessary to slightly open the fingers so that the conductor may be longitudinally moved. This is accomplished by the mechanism disclosed in FIG. 13 in which a rocker arm 212 is swingably supported upon a pivot 213. One end of this rocker arm is arranged to engage the roller 73 of the actuating arm 71 for opening and closing the finger members 62 and 63. The opposite end of the rocker arm 212 is pivotally connected by a pivot 214 to a clevis 215 mounted on a piston rod 216 which is operatively associated with an air cylinder 217 having an end support pivot 218 connecting it to a bracket 219 mounted on an adjacent frame structure. Energization of the air cylinder 217 operates to extend the piston and rotate the rocker arm in a clockwise direction and move the gripping fingers towards an open gripping position. The extent of this movement of the fingers towards an open position is adjustably controlled by means of a thumbscrew 220 supported upon a fixed post 221 and having its inner end positioned in the path of movement of the clevis 215. Upon release of the gripping fingers, the conductor 11 will be forced upwardly into engagement with overlapping lip portions at the outermost ends of the gripping fingers by means of a spring pusher wire 222, as shown in FIGS. 11 and 12.

The operation of the back feed device F will now be briefly described. Upon entry of a conductor 11 into the sensing switch control means 14 and movement to a final position, the main control of the apparatus will first actuate a valve (not shown) to energize the cylinder 83 at the back feed position to lock the finger carriage against further movement by the conveyor. After a pre-determined time delay, a second valve (not shown) will operate to energize the cylinder 161 and close the feed rollers 148 and 155. At the same time, this valve will energize the air cylinder 209 to actuate the raker arms 201 and 202 and force the conductor into engagement with one or both of the sensing arms 186. Also, simultaneously the second valve will energize the air cylinder 217 to slightly open the wire gripping fingers 62 and 63.

If the wire entering the sensing switch control means 14 is a relatively long wire, both switch assemblies 179, 180 will be activated to control the operation of the feed rollers for a fast feeding speed, whereas if a short conductor enters the sensing switch, only the switch assembly 180 will be activated to control the rollers for a slower feeding speed.

From the foregoing, it will be seen that the length of time to complete the back feed operation will vary depending upon the length of the conductor 11, and that the apparatus control means must not be activated to carry a new conductor from the stripping apparatus 10 until the back feed has finished. Accordingly, the apparatus control is arranged to include a sensing switch 223, as shown in FIG. 4, this switch having an actuating element 224 positioned in the path of movement of the rocker arm 79 during its movement to a non-locking position with respect to the carrier plate 60 at the back feed position.

Upon completion of the back feed operation, the conductor 11 is then moved by the conveyor to the second terminal attaching device B which is a mirror image of the first terminal attaching device A, and wherein the second terminal will be attached by a similar operation.

When a conductor finger gripping assembly 50 with a conductor 11 having terminals attached to its opposite ends reaches the outer end of the conveyor mechanism, a camming member 225 will engage and actuate the arm 71 of the approaching finger gripping assembly 50 in a manner to move the fingers to an open position and release the conductor with the attached end terminals for discharge into the collecting trough T, as shown in FIG. 15.

From the foregoing description, it is believed that it will be apparent that the heretofore outlined objects of the invention will be obtained, and that the apparatus embodying the described features provides inherent advantages in the production of electric conductors with a fixed terminal at its opposite ends.

Various modifications may suggest themselves to those skilled in the art without departing from the spirit of the disclosed invention, and hence, it is not wished to be restricted to the specific form shown or uses mentioned, except to the extent indicated in the appended claims.

I claim:

1. Apparatus for attaching terminals to the ends of electric conductors, comprising:

a. means for delivering predetermined lengths of electric conductors into a conductor supply zone;

b. a terminal attaching zone spaced from said conductor supply zone, including spaced apart first and second terminal attaching devices each having cooperable terminal attaching die means for receiving a terminal therebetween having an end portion for the reception of an end of said conductor and being operable to crimp the end portion on the received conductor end;

c. means for picking up and successively transporting the conductor lengths laterally along a conveyor path from the conductor supply zone to said first terminal attaching device for attaching a terminal to one end of the conductor and thereafter transporting the conductor with the terminal attached to said one end to the second terminal attaching device for attaching a terminal to the other end of the conductor.

d. means in the terminal attaching zone including a pair of rotatable conductor gripping rollers operable to longitudinally move said gripped conductor with the terminal attached to said one end by the first terminal attaching device in a direction to bring the opposite end of said conductor into a terminal attaching position by said second terminal attaching device;

e. an electrical motor having a driving connection with one of said rollers;

f. switching means activated by the lateral movement of said conductor to energize said motor, and by longitudinal movement of the conductor to a predetermined sensed position to de-energize said motor and apply a braking force to stop the movement of said conductor by said rollers, said switching means comprising a pair of switches having actuating components laterally spaced relatively to the longitudinal axis of said conductor and being positioned for activation by the conductor during said lateral movement thereof; and g. swingably mounted raker elements operable, upon the approach of the conductor to said switch actuating components, to engage the conductor at positions respectively adjacent said switch actuating components and thereby forcibly augment its movement into operative association with the switch actuating components.

2. Apparatus according to claim 1, in which: said raker elements comprise a pair of arms carried by a rotatably mounted shaft.

3. Apparatus according to claim 2, in which: one of said arms is of greater length than the other.

4. Apparatus according to claim 3, in which: said rotatable shaft is oscillated by means of a connected pneumatic cylinder-piston actuator.

5. Apparatus for attaching terminals to the ends of electric conductors, comprising:

a. means for delivering predetermined lengths of electric conductors into a conductor supply zone;

b. a terminal attaching zone spaced from said conductor supply zone, including spaced apart first and second terminal attaching devices each having cooperable terminal attaching die means for receiving a terminal therebetween having an end portion for the reception of an end of said conductor and being operable to crimp the end portion on the received conductor end;

c. means for picking up and successively transporting the conductor lengths laterally along a conveyor path from the conductor supply zone to said first terminal attaching device for attaching a terminal to one end of the conductor and thereafter transporting the conductor with the terminal attached to said one end to the second terminal attaching device for attaching a terminal to the other end of the conductor, and comprising in each case a pair of conductor gripping fingers mounted on a carrier plate guidingly movable along a guide track to successive positions at the first terminal attaching device, means for longitudinally moving said conductor transversely of the conveyor path, and the second terminal attaching device;

d. a v-notch formed in a side edge of said plate;

e. means including a detent roller at each of said positions supported for movement into said notch to releasably lock the plate and conductor gripping fingers against movement along said guide track;

f. means operable, at the position of the means for longitudinally moving said conductor, for slightly opening the conductor gripping fingers to enable said longitudinal movement of the conductor therein;

g. said fingers having overlapping end flanges for retaining the conductor therebetween, when the fingers are slightly opened;

h. spring means normally biasing said conductor in a direction towards said end flanges; and i. means in said terminal attaching zone for moving said conductor with the terminal attached to said one end by the first terminal attaching device in a direction to position the opposite end of the conductor for placement in said terminal end portion at the second terminal attaching device for attachment thereto.

* * * * *